US010454209B2

(12) United States Patent
Holub et al.

(10) Patent No.: US 10,454,209 B2
(45) Date of Patent: Oct. 22, 2019

(54) CONNECTOR POSITION ASSURANCE DEVICE, A CONNECTOR APPARATUS HAVING MALE AND FEMALE CONNECTOR ASSEMBLIES WITH CONNECTOR POSITION ASSURANCE DEVICE, A MALE CONNECTOR ASSEMBLY, A FEMALE CONNECTOR ASSEMBLY, AND A METHOD FOR ASSEMBLING THE CONNECTOR APPARATUS

(71) Applicant: J.S.T. CORPORATION, Farmington Hills, MI (US)

(72) Inventors: Franklin Holub, West Bloomfield, MI (US); Jong Soo Kim, Farmington Hills, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 15/957,257

(22) Filed: Apr. 19, 2018

(65) Prior Publication Data

US 2018/0316131 A1 Nov. 1, 2018

Related U.S. Application Data

(60) Provisional application No. 62/492,414, filed on May 1, 2017.

(51) Int. Cl.
*H01R 13/627* (2006.01)
*H01R 43/26* (2006.01)
(Continued)

(52) U.S. Cl.
CPC ..... *H01R 13/6275* (2013.01); *H01R 13/4362* (2013.01); *H01R 13/506* (2013.01);
(Continued)

(58) Field of Classification Search
CPC . H01R 13/6275; H01R 13/4362; H01R 43/26
(Continued)

(56) References Cited

U.S. PATENT DOCUMENTS 6,109,955 A 8/2000 Hanazaki
6,261,115 B1 7/2001 Pederson
(Continued)

FOREIGN PATENT DOCUMENTS

WO 2016173971 A1 11/2016

OTHER PUBLICATIONS

U.S. Appl. No. 15/957,284 by Franklin A. Holub et al., filed Apr. 19, 2018.

(Continued)

*Primary Examiner* — Abdullah A Riyami
*Assistant Examiner* — Nelson R. Burgos-Guntin
(74) *Attorney, Agent, or Firm* — Kratz, Quintos & Hanson, LLP

(57) ABSTRACT

A connector position assurance (CPA) device for assuring the full engagement of a female connector assembly and a male connector assembly in a connector apparatus, and the connector apparatus having the female connector assembly and the male connector assembly engaged together when the CPA device is at a full-lock position. Prior to the CPA device being at a full-lock position, the female connector assembly, with the CPA device at a pre-lock position therein, enters the male connector assembly for engagement thereto. At such time, protruding members of a flexible member of the female connector assembly enter a side elongated slot of the male connector assembly. When the CPA device, at the pre-lock position, is further pushed into the female connector assembly, a set of side ledges extending from the CPA device prevents the flexible member of the female connector assembly from being moved or pushed; thus, with the CPA
(Continued)

device at the full-lock position, it is assured that the male and female connector assemblies remain fully engaged.

16 Claims, 12 Drawing Sheets

(51) Int. Cl.
*H01R 13/436* (2006.01)
*H01R 13/506* (2006.01)
*H01R 13/639* (2006.01)

(52) U.S. Cl.
CPC ..... *H01R 43/26* (2013.01); *H01R 13/6272* (2013.01); *H01R 13/639* (2013.01)

(58) Field of Classification Search
USPC ..... 439/352, 752, 595
See application file for complete search history.

(56) References Cited

U.S. PATENT DOCUMENTS 6,276,953 B1 8/2001 Gauker
6,354,860 B1 3/2002 Miller
6,435,895 B1 8/2002 Fink
6,491,542 B1 12/2002 Zerebilov
6,780,045 B2 8/2004 Shuey
6,811,424 B2 * 11/2004 Seminara ..... H01R 13/639 439/188
6,866,534 B2 3/2005 Hirschmann
7,267,569 B2 9/2007 Nakamura
7,326,074 B1 2/2008 Lim
7,399,195 B2 7/2008 Kim
7,470,138 B1 12/2008 Chen
7,601,019 B2 10/2009 Hsieh
7,909,638 B2 3/2011 Seo
8,016,606 B1 9/2011 Kwan
8,137,142 B1 3/2012 Dawson
8,376,773 B2 * 2/2013 Ma ..... H01R 13/639 439/347
8,747,146 B2 6/2014 Brown
8,926,355 B2 1/2015 Heil
9,071,015 B1 6/2015 Tan
9,478,906 B2 10/2016 Myer
9,876,312 B1 1/2018 Li
9,893,467 B2 * 2/2018 Chen ..... H01R 13/639
10,038,278 B2 * 7/2018 Lane ..... H01R 13/6272
2003/0162444 A1 8/2003 Hayashi
2004/0248453 A1 12/2004 McLauchlan et al.
2007/0161284 A1 7/2007 Tyler
2008/0248668 A1 10/2008 Ripper
2009/0023325 A1 * 1/2009 Chen ..... H01R 13/506 439/352
2009/0298320 A1 12/2009 Schmitt
2010/0233897 A1 9/2010 Seo
2012/0282791 A1 11/2012 Brown
2013/0260590 A1 10/2013 Hitchcock
2014/0302702 A1 * 10/2014 Germ ..... H01R 13/02 439/370
2016/0204551 A1 7/2016 Kanda
2017/0062982 A1 * 3/2017 Holub ..... H01R 13/6271
2017/0063003 A1 3/2017 Spencer
2017/0077646 A1 3/2017 Kim
2017/0170601 A1 * 6/2017 Chen ..... H01R 13/639
2017/0250501 A1 8/2017 Endo
2018/0062314 A1 * 3/2018 Schmidt ..... H01R 13/639

OTHER PUBLICATIONS

International Search Report in PCT/US2018/029822, dated Jul. 2, 2018.
Written Opinion in PCT/US2018/029822, dated Jul. 2, 2018.
International Search Report in PCT/US2018/029813, dated Jul. 6, 2018.
Written Opinion in PCT/US2018/029813, dated Jul. 6, 2018.
Office Action of U.S. Appl. No. 15/957,284 dated Sep. 27, 2018 (15 pages, 3 pages Notice of References Cited, 18 pages total).

* cited by examiner

CONNECTOR POSITION ASSURANCE DEVICE, A CONNECTOR APPARATUS HAVING MALE AND FEMALE CONNECTOR ASSEMBLIES WITH CONNECTOR POSITION ASSURANCE DEVICE, A MALE CONNECTOR ASSEMBLY, A FEMALE CONNECTOR ASSEMBLY, AND A METHOD FOR ASSEMBLING THE CONNECTOR APPARATUS

CROSS-REFERENCE TO RELATED APPLICATIONS

This patent application claims priority to U.S. Provisional Patent Application No. 62/492,414 filed May 1, 2017, which is hereby incorporated herein by reference in its entirety.

BACKGROUND OF THE INVENTION

The present invention generally relates to a connector position assurance (CPA) device for assuring the engagement of male and female connector assemblies, a connector apparatus having the male connector assembly and the female connector assembly, the male connector assembly having a male terminal position assurance (TPA) device for connecting thereto at least a set of terminals, and the female connector assembly having a female terminal position (TPA) device for connecting thereto at least a set of terminals. The female connector assembly further includes the CPA device for locking the male and female connector assemblies together.

SUMMARY OF THE INVENTION

A connector position assurance (CPA) device for assuring the engagement of male and female connector assemblies is inserted into the female connector assembly, at a pre-lock position and then, at a full-lock position. Further, to ensure that the female terminal position assurance (TPA) device is made available for connecting to the female connector assembly during transport thereof, the female TPA is engaged, in a pre-lock position, to the female connector assembly. A male terminal position assurance (TPA) device may be made available for connecting to the male connector assembly during transport thereof, the male TPA being able to be engaged, in a pre-lock position, to the male connector assembly. In addition to the female TPA at a pre-lock position engagement with the female connector assembly, the female connector assembly engages thereto, during the transport thereof, with the connector position assurance (CPA) device at a pre-lock position.

At least a terminal is provided into each of the male connector assembly and the female connector assembly, when each of their respective male TPA and female TPA is at a pre-lock position. The male connector assembly and female connector assembly are engaged together, and the engagement thereof is assured when the CPA device is placed at a full-lock position. The set of terminals provided for the male connector assembly is secured thereto when the male TPA thereof is placed at a full-lock position. Similarly, the set of terminals provided for the female connector assembly is secured thereto when the female TPA device thereof is placed at a full-lock position.

With the female TPA device being at a full-lock position, the female connector assembly can enter the inside of the male connector assembly, and both the male and female connector assemblies can be fully engaged together with the CPA device and the full engagement thereof is assured when the CPA device is at a full-lock position.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanations without limiting the scope of the invention as claimed.

DETAILED DESCRIPTION OF THE PREFERRED EMBODIMENTS

Figure 1:
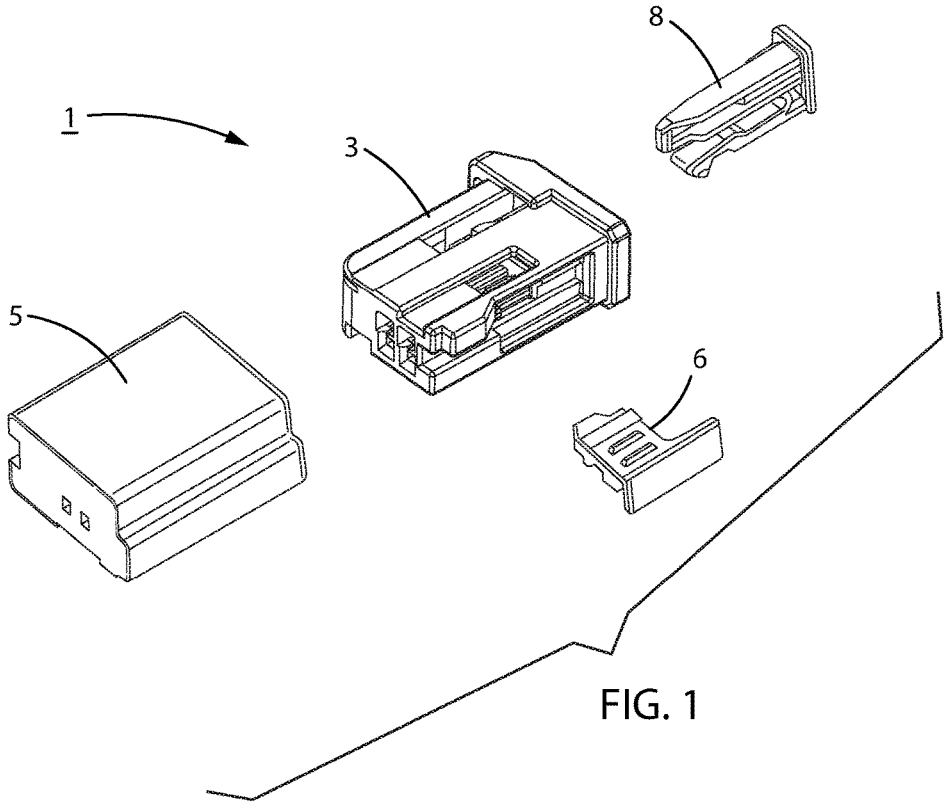
FIG. 1 is an exploded perspective view of the connector apparatus of the present invention having male and female connector assemblies, along with the connector position assurance (CPA) device, the female terminal position assurance (TPA) device also being shown.

FIG. 1 illustrates, in an exploded perspective view, the connector apparatus, generally referred to by reference number 1, which includes a female connector assembly 3 and a male connector assembly 5. The female connector assembly 3 includes a female terminal position assurance (TPA) device 6 and a connector position assurance (CPA) device 8.

Figure 2A:
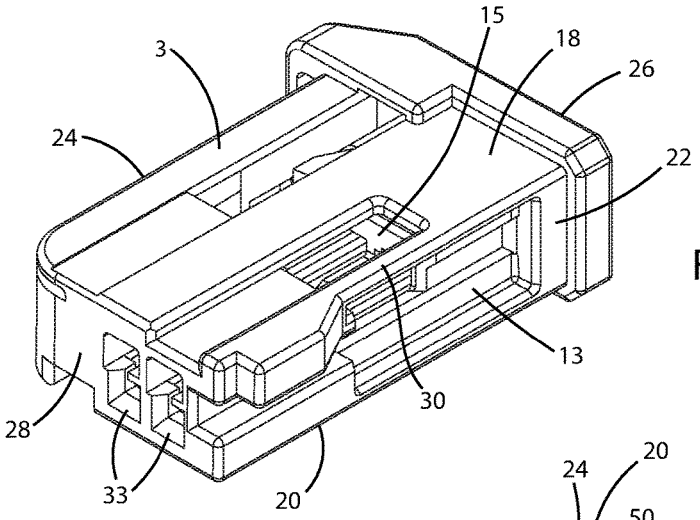
FIG. 2A is a top perspective view of the female connector assembly.
Figure 2B:
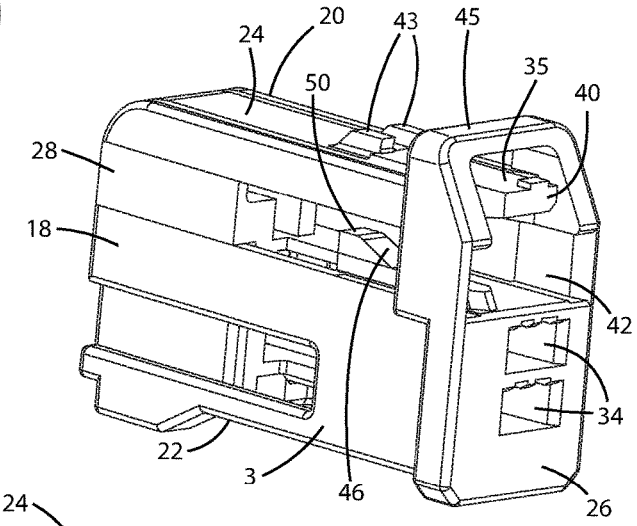
FIGS. 2B and 2C are side perspective views of the female connector assembly.
Figure 2C:
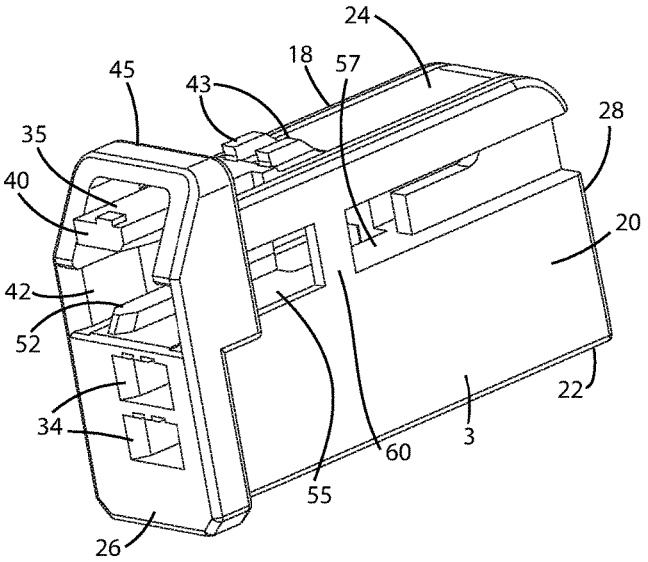

FIGS. 2A, 2B, and 2C show the female connector assembly having an upper side 18, a lower side 20, a first side 22, a second side 24, a front end side 26, and a back end side 28.

FIGS. 2A and 2B illustrate the female connector assembly 3, which includes a side slot 13 on the first side 22 thereof and a top slot 15 on the upper side 18 thereof. As explained later, the side slot 13 receives the female terminal assurance (TPA) device 6. Between the side slot 13 and the top slot 15 is an elongated member 30. Passing through a portion of the back end side 28 is a set of terminal slots 33.

Further illustrated in FIG. 2B is a flexible member 35 extending along the second side 24 of the female connector assembly 3, a front end 40 of the flexible member 35 extending near an opening 42 of the front end side 26 of the female connector assembly 3. At an intermediate portion of the flexible member 35 are protruding members 43 extending therefrom. Also passing through the front end side 26 is another set of terminal slots 34. Bounded at an upper portion of the opening 42 is a substantially U-shaped member 45.

As will be explained later in more detail, the female connector assembly 3 includes a substantially ramp-like member 46 with a substantially flat portion 50 at an upper portion thereof continuing with an elongated guide member 52.

As shown in FIG. 2C, passing through the lower side 20 of the female connector assembly 3 are a first window 55 and a second window 57. Therebetween the first and second windows 55, 57 is a bridge member 60.

Figure 3A:
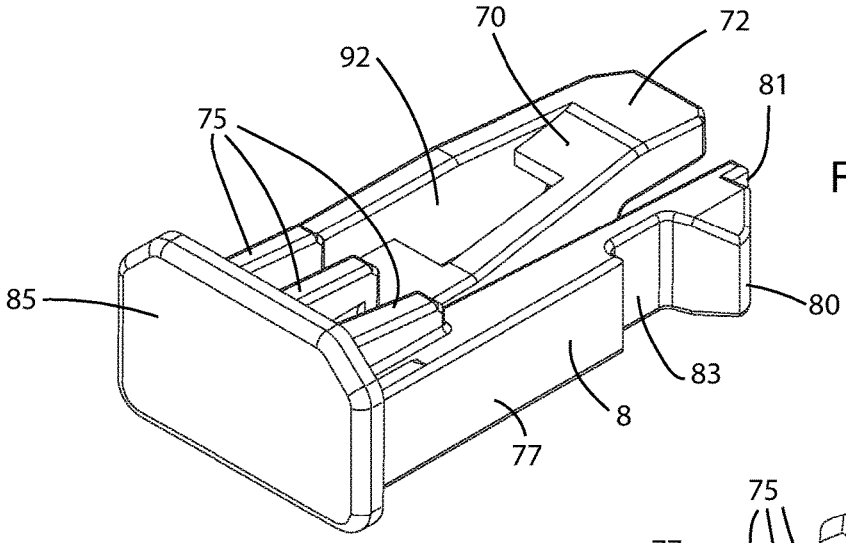
FIGS. 3A and 3B are perspective views of the connector position assurance (CPA) device of this invention.
Figure 3B:
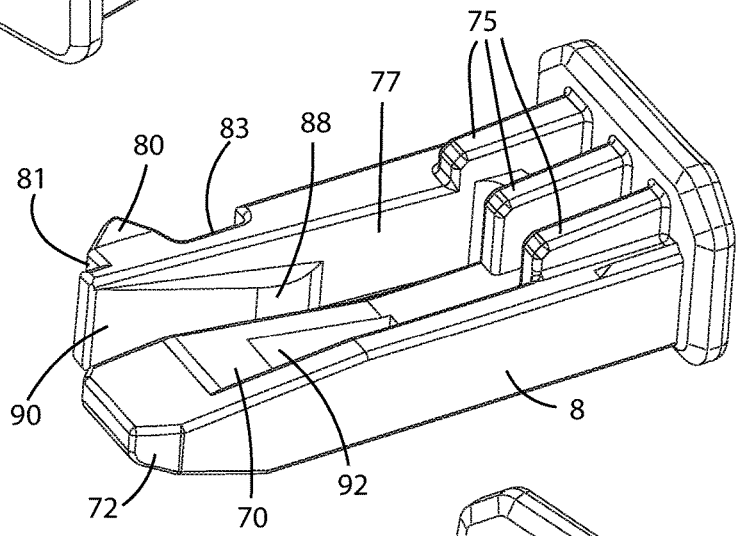
Figure 3C:
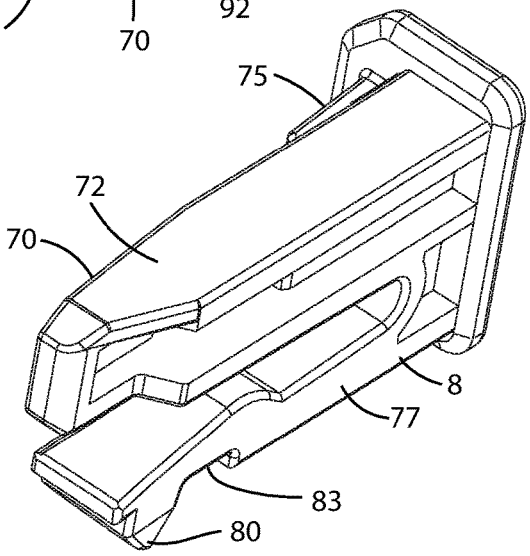
FIG. 3C is a side perspective view of the CPA device of this invention.

FIGS. 3A, 3B, and 3C are perspective views of the CPA device 8 for locking the female connector assembly 3 and the male connector assembly 5 together, at a pre-lock position or at a full-lock position. Shown in FIG. 3A are a flexible side member 70 with a side end portion 72 and a set of side ledges 75. The CPA device 8 further includes a flexible bottom side member 77 with a wedge-like member 80 at an end thereof. Adjacent the base of the wedge-like member 80 is a front ledge 81 and a back ledge 83. The CPA device 8 has an end portion 85.

Further shown in FIG. 3B is the CPA device 8 further including an inner flexible member 88 attached to an end 90 thereof to the flexible bottom side member 77. The inner flexible member 88 provides a spring-like action or an essential resilience property for the flexible bottom side member 77, as will later be discussed. Further shown in FIGS. 3A and 3B is an opening 92, preferably elongated, the opening 92 passing through an inner portion of the flexible side member 70.

As further shown in FIGS. 3A, 3B, and 3C, the back ledge 83 near the wedge-like member 80 and the wedge-like member 80 form a substantially U-shaped portion on the bottom side member 77, the significance of which will later be discussed. The flexible bottom side member 77 is flexible towards the flexible side member 70.

Figure 4:
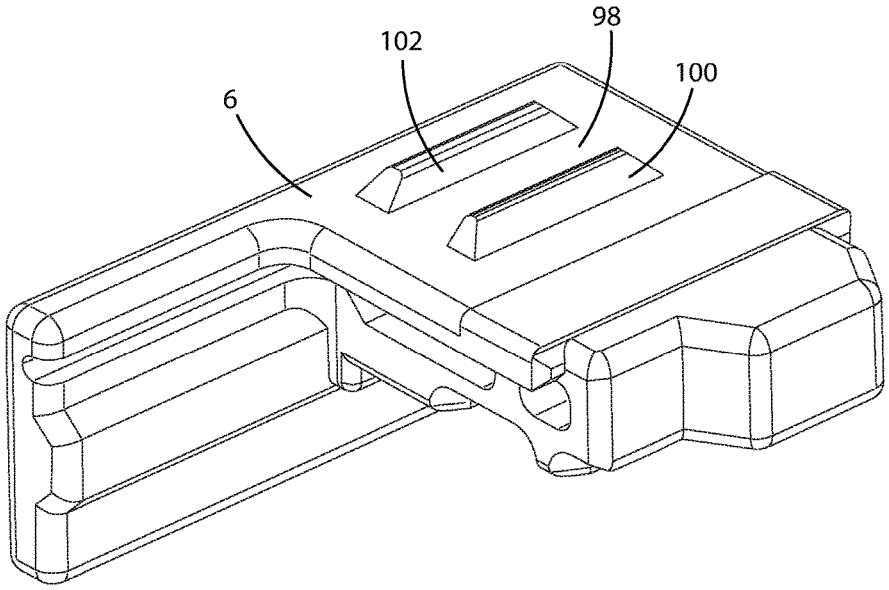
FIG. 4 is a perspective view of the terminal position assurance (TPA) device of the female connector assembly.

FIG. 4 illustrates the TPA device 6 of the female connector assembly 3. The TPA device 6 is substantially L-shaped, although the general shape thereof is not limited thereto. Extending from a top portion 98 of the female TPA device 6 are a pair of elongated members 100, 102.

Figure 5A:
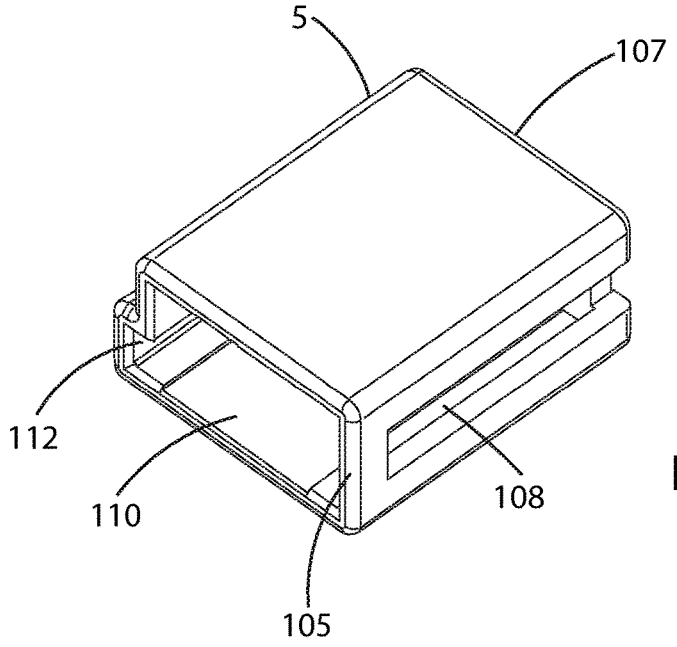
FIG. 5A is a top perspective view of the male connector assembly.

Generally shown in FIG. 5A is the male connector assembly 5, shown in a generic form, having a one end portion 105 and another end portion 107. The male connector assembly 5 includes a second side elongated slot 108. An opening 110, for accommodating therein the female connector assembly 3, has an opening portion 112 with a wider width. When shown at a side end elevational view of the male connector assembly 5 (i.e., when viewed from the opening 110), FIG. 5B illustrates an internal space 103 for accommodating therein the female connector assembly 3, and further illustrates a set of terminal apertures 106 at the end portion 107 of the male connector assembly 5.

Figure 5B:
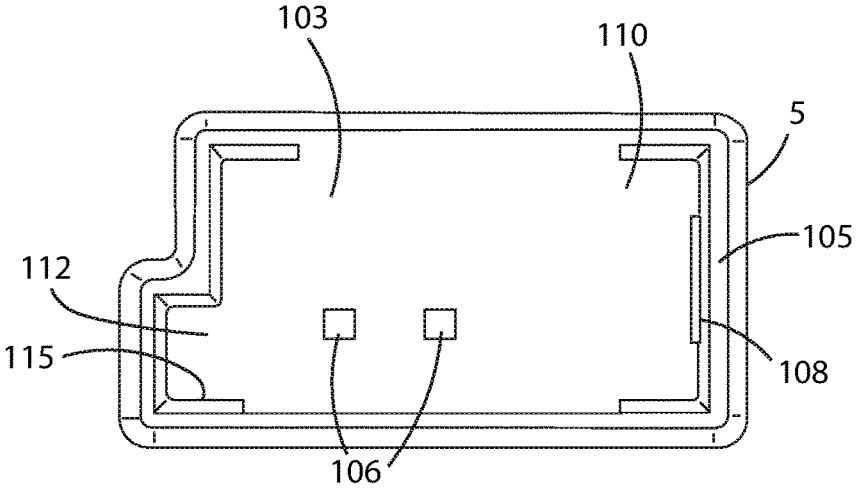
FIG. 5B is a side end elevational view of the male connector assembly.

As also illustrated in FIG. 5B, the opening portion 112 includes substantially U-shaped side portions 115 for guiding the entry of the female connector assembly 3 through the opening 110 of the male connector assembly 5. Further, although not shown in the drawings, the internal space 103 may accommodate therein a male terminal position assurance (TPA) device for securing therein a set of terminals passing through the set of terminal apertures 105.

The method for assembling the connector apparatus 1 of this invention is hereinafter explained and discussed.

Figure 6A:
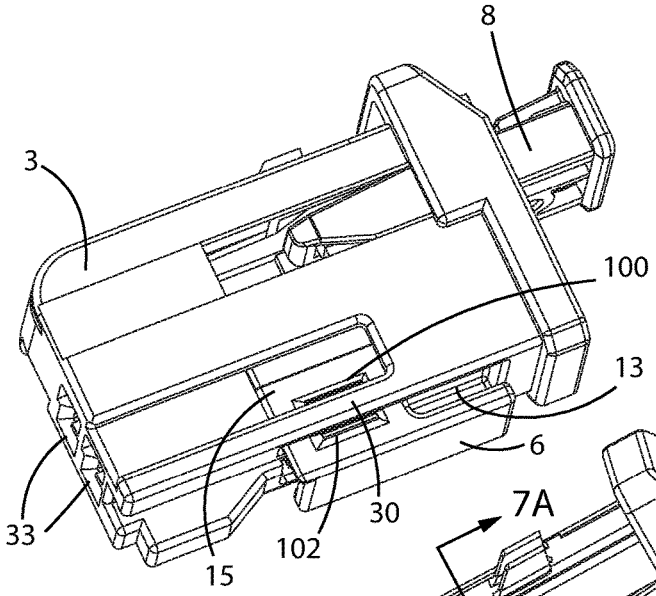
FIGS. 6A and 6B are top and side perspective views of the female connector assembly, respectively, having its female TPA device and the CPA device both at pre-lock positions, ready for transport.
Figure 6B:
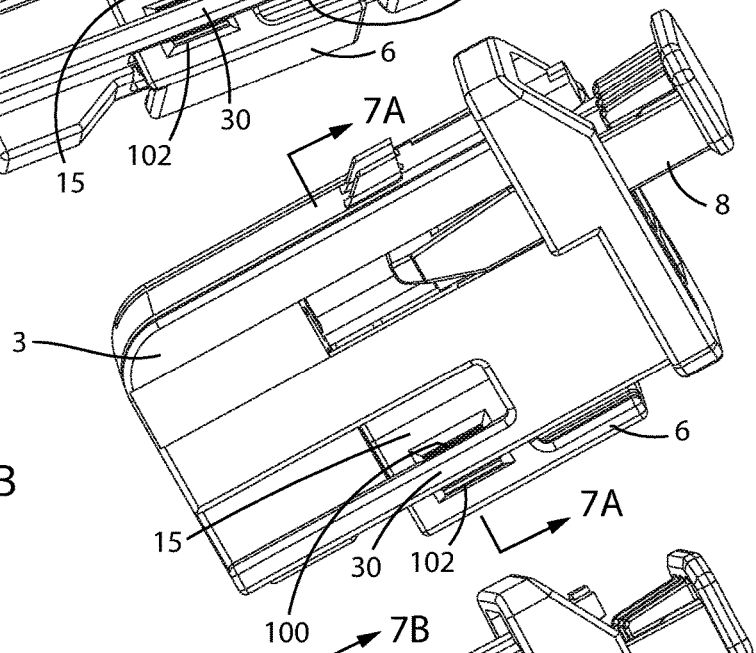

As shown in FIG. 6A, the TPA device 6 of the female connector assembly 3 is inserted into the side slot 13 of the female connector assembly 3 such that the elongated member 100 passes beneath the elongated member 30 and becomes positioned within the top slot 15 of the female connector assembly 3, the TPA device 6 being in a pre-lock position. As shown in FIGS. 6A and 6B, the CPA device 8 is in a pre-lock position with the female connector assembly 3, while the TPA device 6 is similarly in a pre-lock position. With the TPA device and the CPA device 8 in pre-lock positions, the female connector assembly 3 is ready for transport.

Figure 6C:
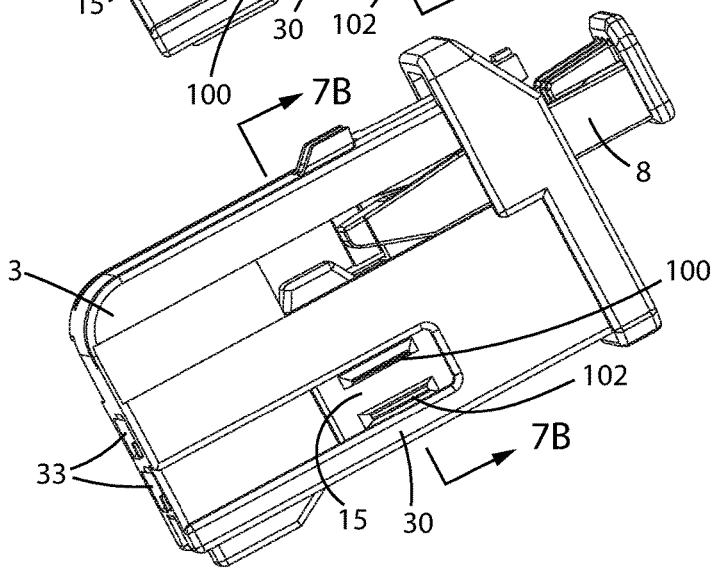
FIG. 6C is a side perspective view of the female connector assembly having the CPA device in a pre-lock position and its female TPA device in a full-lock position.

When a set of terminals (not shown) is inserted through the set of terminal slots 33 of the female connector assembly 3, the TPA device 6 is further pushed inward through the side slot 13 with the elongated member 102 of the TPA device 6 being pushed past the elongated member 30 of the female connector assembly 3 and passes into the top slot 15 of the female connector assembly 3. The TPA device 6 is then at a final-lock position, as shown in FIG. 6C.

Figure 7A:
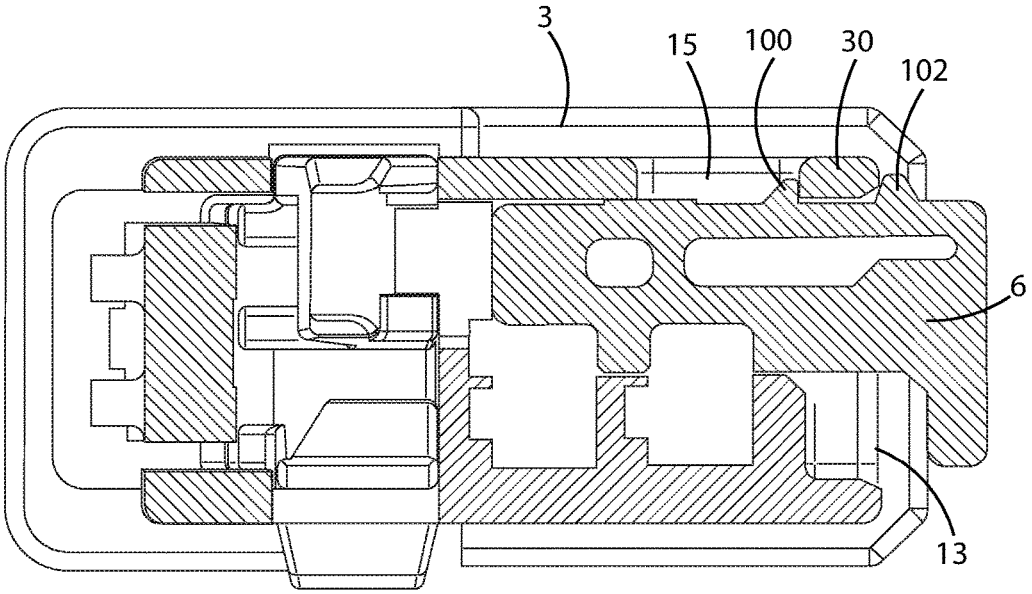
FIG. 7A is a cross-sectional view, taken along line 7A-7A in FIG. 6B, showing the female TPA device of the female connector assembly in its pre-lock position.
Figure 7B:
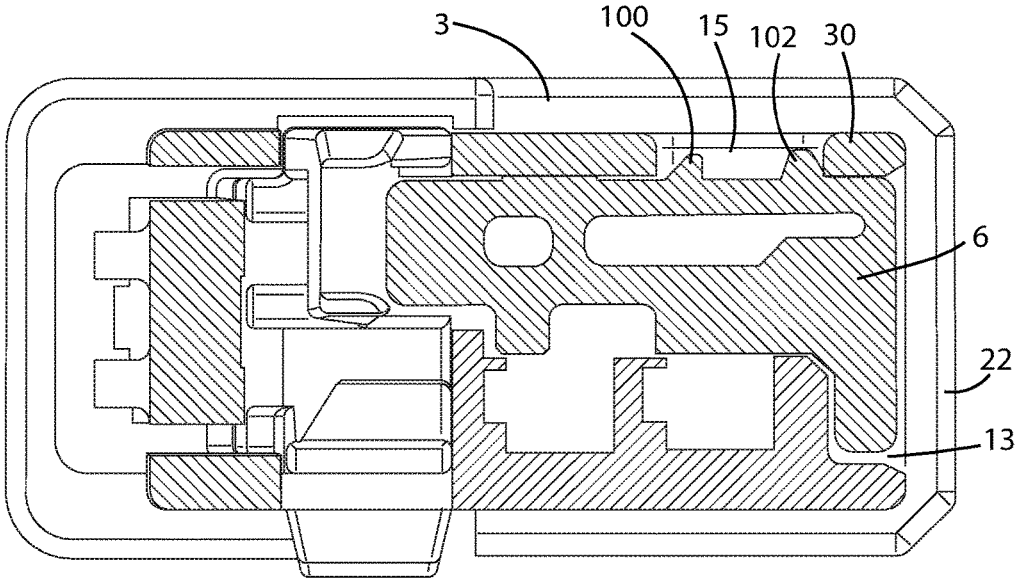
FIG. 7B is a cross-sectional view, taken along line 7B-7B in FIG. 6C, showing the female TPA device of the female connector assembly in its full-lock position.

As further shown in the cross-sectional views of FIGS. 7A and 7B (and as discussed above with respect to FIGS. 6A and 6B), the TPA device 6 is at a pre-lock position when, as shown in FIG. 7A, the elongated member 100 of the TPA device 6, while the TPA device 6 is being pushed through the side slot 13, passes the elongated member 30 of the female connector assembly 3 and into the top slot 15 of the female connector assembly 3. When the TPA device 6 is further pushed inside the female connector assembly 4, through the side slot 13, the elongated member 102 of the TPA device 6 passes the elongated member 30 of the female connector assembly 3 and into the top slot 15. As shown in FIG. 7B, the TPA device 6 is fully inserted into the female connector assembly 3 so that no part of the TPA device 6 extends beyond pass the first side 22 of the female connector assembly 3. When the TPA device 6 is in a full-lock position within the female connector assembly 3, the TPA device 6 has secured the set of terminals (not shown) intended to be joined with the female connector assembly 3, and the female connector assembly 3 is ready to be inserted into the male connector assembly 5 for coupling thereto. That is, no part of the TPA device 6 extends beyond the first side 22 of the female connector assembly 3 to permit the female connector assembly 3 to fully enter, unimpeded, through the openings 110, 112 (see FIG. 5B) and into the male connector assembly 5. After the female connector assembly 3 (with its TPA device 6 in a full-lock position therein) has been fully inserted into the male connector assembly 5, the CPA device 8 (at a pre-lock position inside the female connector assembly 3) can be further inserted into the female connector assembly 3 at a full-lock position therein to ensure that the female and male connector assemblies 3, 5 become fully engaged.

Hereinafter described is the method for locking the female connector assembly 3 and the male connector assembly 5 with the CPA device 8, at a pre-lock position and subsequently, at a full-lock position. It is hereby noted that it is preferable that only two assemblies are to be transported to a location for full assembly; namely: (1) the female connector assembly 3 with its TPA device 6 at a pre-lock position therein and the CPA device 8 similarly at a pre-lock position therein, and (2) the male connector assembly 5 with its TPA device (not shown in the drawings) at a pre-lock position therein.

Figure 8:
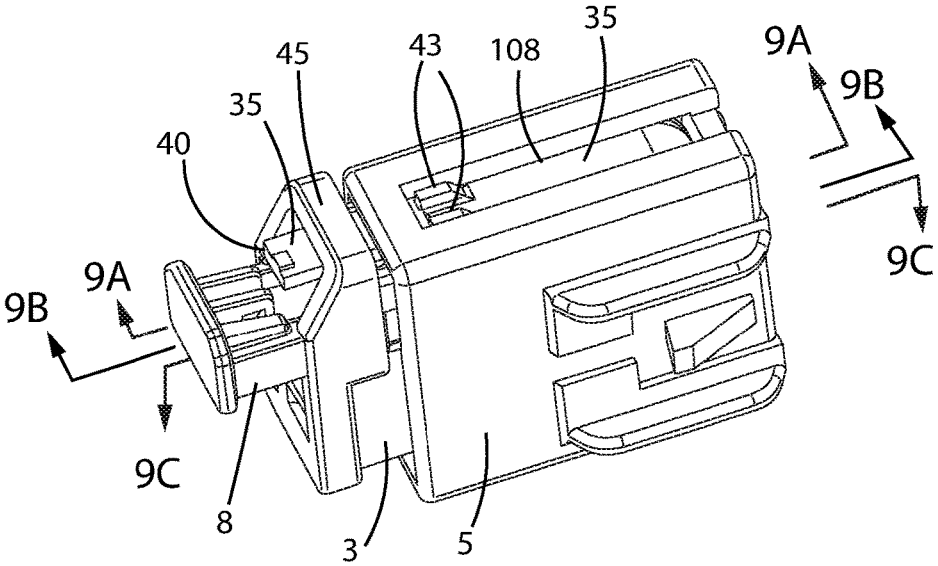
FIG. 8 is a perspective view of the connector apparatus of this invention with its male and female connector assemblies assembled with the CPA device at a pre-lock position.
Figure 9A:
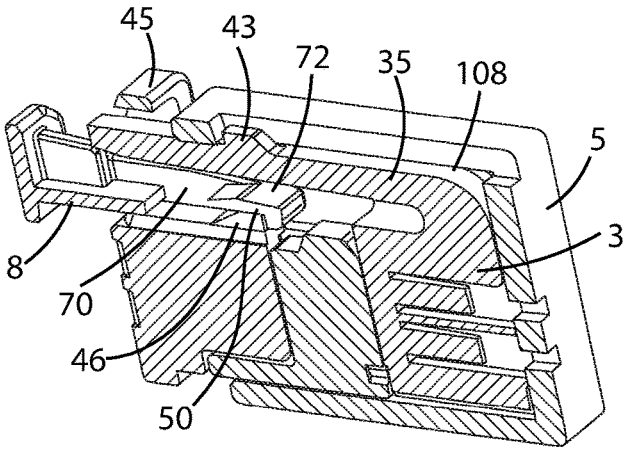
FIGS. 9A, 9B, and 9C are cross-sectional views taken along lines 9A-9A, 9B-9B, and 9C-9C, respectively, in FIG. 8, showing the assembled male and female connector assemblies with the CPA device is at a pre-lock position.
Figure 9B:
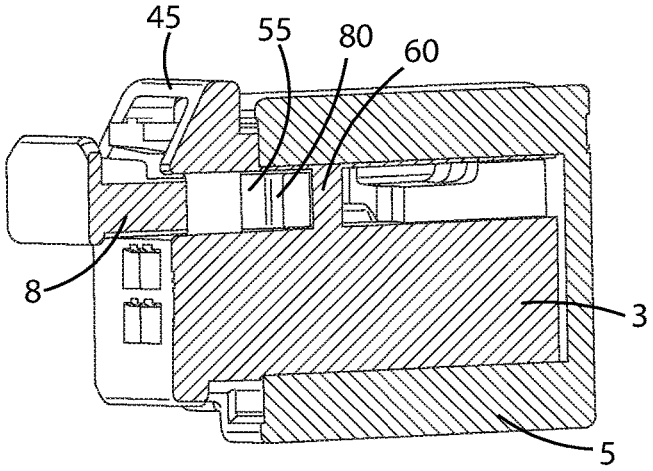
Figure 9C:
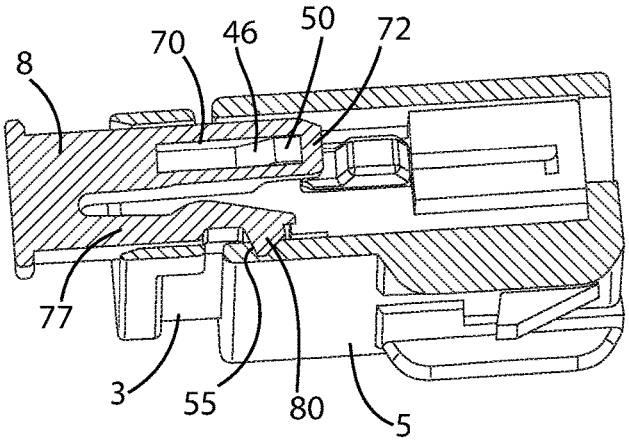
Figure 10:
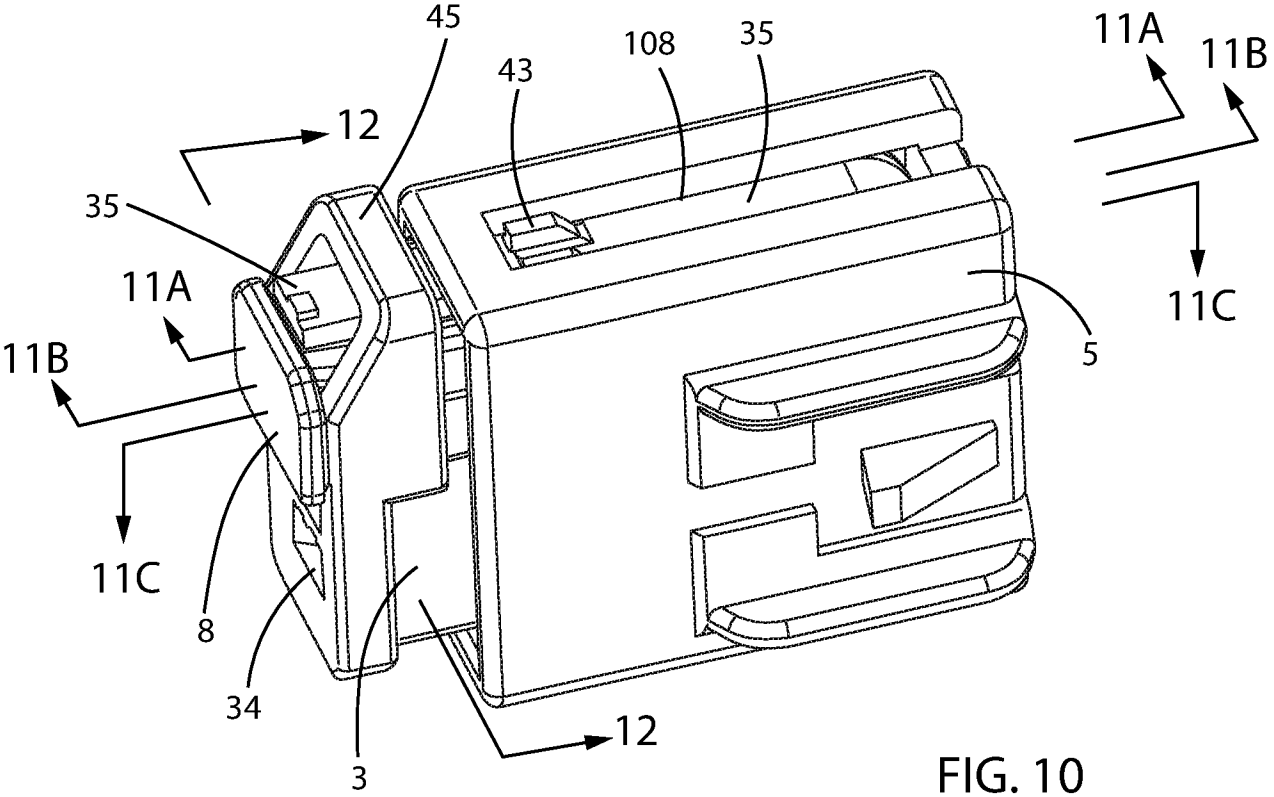
FIG. 10 is a top perspective view of the connector apparatus of this invention with its male and female connector assemblies fully assembled with the CPA device at a full-lock position.

FIGS. 8, 9A, 9B, and 9C illustrate the female connector assembly 3 and the male connector assembly 5 being engaged, while the CPA device 8 is at a pre-lock position. Here, as shown in FIGS. 8 and 9A, the protruding members 43 extending from the flexible member 35 (as discussed above in describing FIG. 2B) of the female connector assembly 3 has entered the second side elongated slot 108 (see, also, FIG. 5A) of the male connector assembly 5. As shown in FIGS. 9B and 9C, the CPA device 8, at a pre-lock position, has its wedge-like member 80 of its flexible bottom side member 77 (see, also, FIG. 3A) enter the first window 55 (as discussed above in describing FIG. 2C) of the female connector assembly 3. To signify completed entry of the wedge-like member 80 into the first window 55, a sound (preferably, a clicking sound or the like) may be heard. The ease in ensuring that the wedge-like member 80 can readily travel into the first window 55 and later traverse the bridge member 60 (as discussed later), between the first and second windows 55, 57 of the female connector assembly 3 (see, also, FIG. 2C), the front face of the wedge-like member 80 is preferably in an inclined shape, and the inner flexible member 88 (attached at an end 90 thereof to the flexible bottom side member 77 of the CPA device) provides the spring-like action or the essential resilience property of the flexible bottom side member 77 (see, also, FIG. 3B).

Also, at a pre-lock position (as illustrated in FIGS. 9A and 9C), the side end portion 72 of the flexible side member 70 (see, also, FIGS. 3A, 3B, and 3C) of the CPA device 8 has traversed the elongated guide member 52 and the ramp-like member 46 (see, also, FIG. 2B) of the female connector assembly 3 and the side end portion 72 rests upon the substantially flat portion 50 of the ramp-like member 46. Upon the resting of the side end portion 72 onto the substantially flat portion 50, a sound (also preferably a clicking sound or the like) may be heard. At this time, the wedge-like member 80 of the CPA device 8 (fitted inside the first window 55 of the female connector assembly 3) prevents the CPA device 8 from traversing further forward, while the side end portion 72 of the CPA device 8 mounted onto the substantially flat portion 50 of the ramp-like member 46 of the female connector assembly 3 prevents the CPA device 8 from traversing backwards.

With the CPA device 8 now at a pre-lock position inside the female connector assembly 3 (and the TPA device 6 also now at a pre-lock position inside the female connector assembly 3), the female connector assembly 3 is ready to be transported to a location where both the female connector assembly 3 can be engaged with the male connector assembly 5 (preferably with its male TPA device (not shown) at a pre-lock position inside the male connector assembly 5 when being transported or the male TPA device (not shown) at a full-lock position when engaging therein the set of terminals (also not shown) and then inserted into the female connector assembly 3 for engagement thereto).

Hereinafter described in reference to FIGS. 10, 11A, 11B, 11C, and 12 is the manner in which the CPA device 8 is placed at a full-lock position with the female connector assembly 3 to ensure that the female and male connector assemblies 3, 5 become fully engaged and locked together.

As discussed above, when the female connector assembly 3 enters the male connector assembly 5, the protruding members 43 of the flexible member 35 of the female connector assembly 5 enter the second side elongated slot 108 of the male connector assembly 5. When the CPA device 8 is at a pre-lock position, the flexible member 35 may still be pushed so that the protruding members 43 may be similarly pushed to clear the side of the male connector assembly 5 and thereafter, if desired, the female connector assembly 4 may be still be pulled away from the male connector assembly 5. However, when the CPA device 8 is at a full-lock position, as shown in FIGS. 10, 11A, 11B, 11C, and 12, the set of side ledges 75 (see, FIG. 12) of the CPA device 8 will prevent the flexible member 35 of the female connector assembly 3 from being pushed and thus, prevent the protruding members 43 thereof from being pushed and will therefore be unable to clear the side of the male connector assembly 5 when pulled, and the female connector assembly 3 cannot therefore be pulled away from the male connector assembly 5.

Figure 11A:
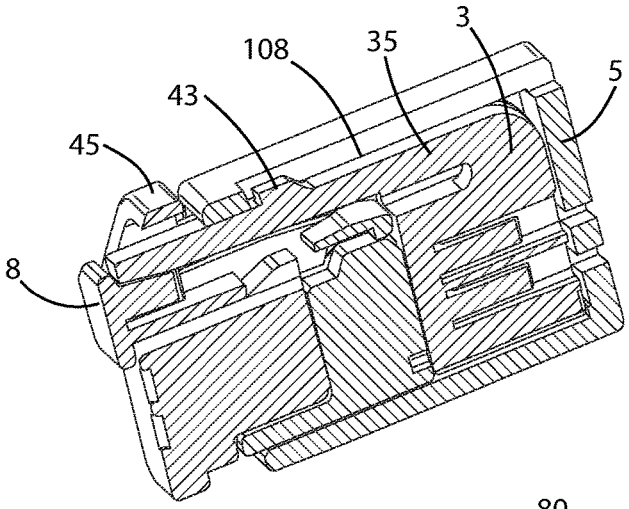
FIGS. 11A, 11B, and 11C are cross-sectional views taken along lines 11A-11A, 11B-11B, and 11C-11C, respectively, in FIG. 10, showing the male and female connector assemblies fully assembled with the CPA device at a full-lock position.
Figure 11B:
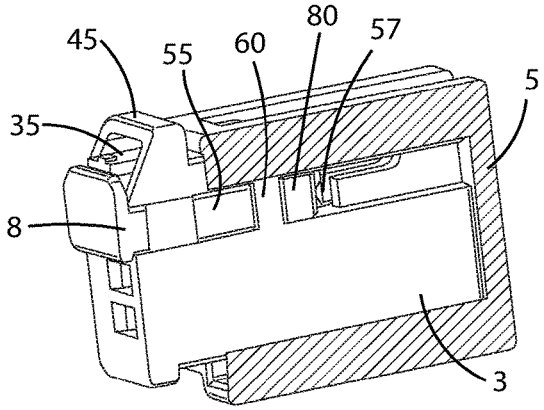
Figure 11C:
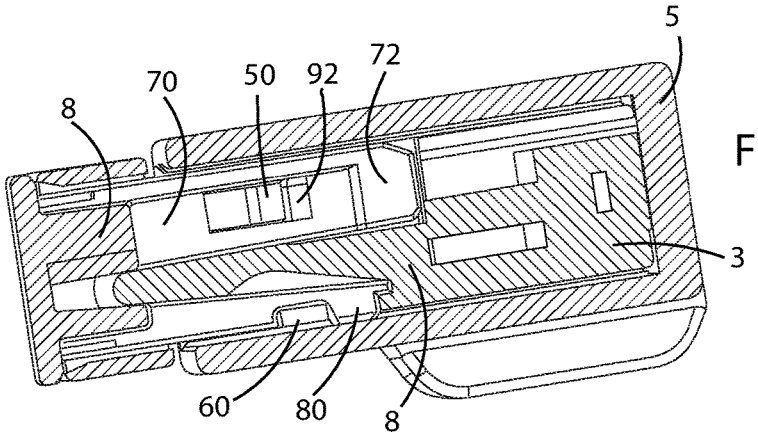
Figure 12:
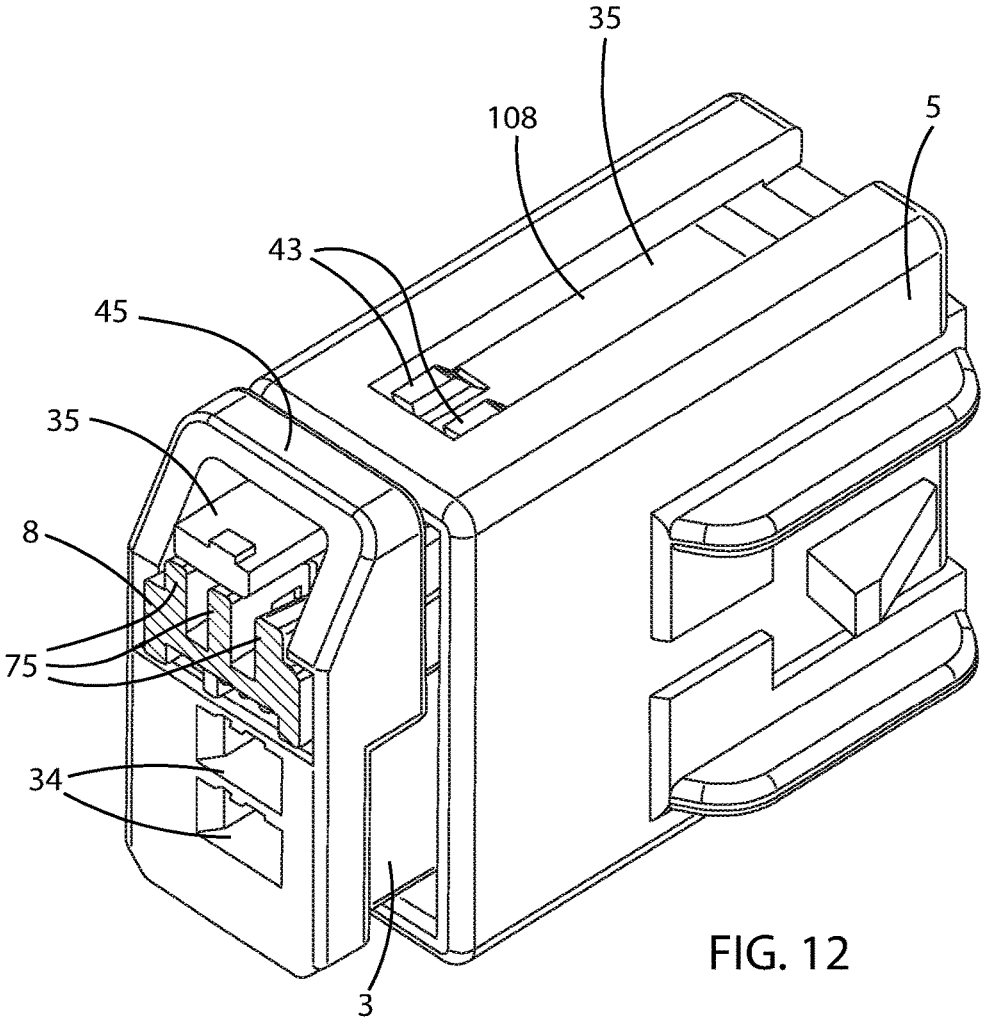
FIG. 12 is a top end elevational view of the assembled connector apparatus showing the male and female connector assemblies fully assembled with the CPA device at a full-lock position and further showing a partial cross-section of a set of side ledges and an end portion of the CPA device located beneath a flexible member of the female connector assembly for assuring that the CPA device stays in a full-lock position and for further assuring that the male and female connector assemblies remain engaged together.

The CPA device 8 is at a full-lock position with the female connector assembly 3 when the CPA device 8 (at a pre-lock position) is further pushed into the female connector assembly 3. At such time, the wedge-like member 80 of the CPA device 8 traverses the bridge member 60 (between the first and second windows 55, 57) and into the second window 57 of the female connector assembly 3 (see, FIGS. 11B and 11C). Upon entry of the wedge-like member 80 into the second window 57, a sound (preferably a clicking sound or the like) may be heard. On or about the time the wedge-like member 80 enters the second window 57, as shown in FIGS. 11B and 11C, the side end portion 72 of the flexible side member 70 of the CPA device 8 (see, also, FIGS. 3A, 3B, and 3C) traverses the substantially flat portion 50 of the ramp-like member 46 of the female connector assembly 3, and the substantially flat portion 50 enters the opening 92 that passes through the inner portion of the flexible side member 70 (see, also, FIGS. 3A and 3B) of the CPA device 8. Upon entry of the substantially flat portion 50 of the female connector assembly 3 inside the opening 92 of the flexible side member 70 of the CPA device 8, a sound (also preferably a clicking sound or the like) may be heard, and the CPA device 8 is at a full-lock position. In addition, when the CPA device 8 is at a full-lock position, the set of side ledges 75 of the CPA device 8 are positioned beneath the flexible member 35, as shown in FIG. 12, and thus, the flexible member 35 cannot be pushed and consequently, the protruding members 43 of the flexible member 35 cannot clear the side within the second side elongated slot 108 of the male connector assembly 5. Thus, with the CPA device 8 at a full-lock position, the female connector assembly 3 cannot be pulled away from the male connector assembly 5, and thereby ensuring that the female and male connector assemblies 3, 5, when engaged, remain fully locked together.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

We claim:

1. A connector apparatus, comprising:

a female connector assembly for receiving a set of terminals, wherein the female connector assembly has an opening at one end thereof;

a male connector assembly for receiving another set of terminals, wherein the male connector assembly receives therein the female connector assembly for engagement thereto; and a connector position assurance (CPA) device for entering the opening of the female connector assembly, and assures the full engagement of the male and female connector assemblies when the CPA device is at a full-lock position, wherein the CPA device includes at least a flexible member having a substantially elongated slot for accommodating therein a substantially ramp-like member of the female connector assembly when the CPA device is at a full-lock position.

2. The connector apparatus as in claim 1, wherein the female connector assembly includes members for allowing the CPA device to be at a pre-lock position therein during transport of the female connector assembly.

3. The connector apparatus as in claim 1, wherein the CPA device includes a first flexible member having a portion thereof that enters a first window of the female connector assembly when the CPA device is at a pre-lock position.

4. The connector apparatus as in claim 3, wherein the device includes a second flexible member that traverses a substantially ramp-like member inside the female connector assembly and mounts onto an upper part of the substantially ramp-like member when the CPA device is at a pre-lock position.

5. The connector apparatus as in claim 3, wherein the portion of the first flexible member of the CPA device enters a second window of the female connector assembly when the CPA device is at a full-lock position.

6. The connector apparatus as in claim 4, wherein the upper portion of the substantially ramp-like member of the female connector assembly enters the substantially elongated slot of the second flexible member of the CPA device when the CPA device is at a full-lock position.

7. A connector position assurance (CPA) device for engaging female and male connector assemblies together in one of a pre-lock position and a full-lock position, the CPA device comprising:

a first flexible member; and a second flexible member, wherein the second flexible member has a substantially elongated slot for accommodating therein a substantially ramp-like member of the female connector assembly when the CPA device is at a full-lock position.

8. The CPA device as in claim 7, wherein the first flexible member includes a portion that enters a first window of the female connector assembly when the CPA device is at a pre-lock position.

9. The CPA device as in claim 7, wherein the second flexible member traverses a substantially ramp-like member inside the female connector assembly and mounts onto an upper part of the substantially ramp-like member when the CPA device is at a pre-lock position.

10. The CPA device as in claim 8, wherein the portion of the first flexible member enters a second window of the female connector assembly when the CPA device is at a full-lock position.

11. The CPA device as in claim 9, wherein the upper portion of the substantially ramp-like member of the female connector assembly enters the substantially elongated slot of the second flexible member when the CPA device is at a full-lock position.

12. The CPA device as in claim 11, further comprising at least a side ledge that is positioned beneath a flexible member of the female connector assembly when the CPA device is at a full-lock position, wherein the flexible member of the female connector assembly includes protruding members that are inside an elongated slot of the male connector assembly to prevent the female connector assembly from being pulled away from the male connector assembly with the side ledge assuring that the flexible member of the female connector assembly is unable to move, thereby assuring that the male and female connector assemblies remain fully engaged when the CPA device is at a full-lock position.

13. A female connector assembly for engaging with a male connector assembly, comprising a flexible member; and a side with a first window and a second window, wherein a CPA device as in claim 7 enters the female connector assembly at the pre-lock position when the CPA device engages with the female connector assembly at the first window thereof, and at the full-lock position when the CPA device engages with the female connector assembly at the second window thereof.

14. A male connector assembly for engaging with a female connector assembly, comprising a side having an elongated slot for accommodating therein protruding members of a flexible member of the female connector assembly when the CPA device as in claim 7 is at one of the pre-lock position and the full-lock position inside the female connector assembly.

15. A method for assembling a male connector assembly and a female connector assembly, comprising the steps of:

inserting a connector position assurance (CPA) device and a female terminal position assurance (TPA) device, at pre-lock positions, into the female connector assembly;

inserting a male terminal position assurance (TPA) device, at a pre-lock position, into the male connector assembly;

inserting the female TPA device and the male TPA device, at full-lock positions, into the female connector assembly and the male connector assembly, respectively;

inserting the female connector assembly into the male connector assembly; and further inserting the CPA device into the female connector assembly at a full-lock position to assure that the male and female connector assemblies remain engaged, wherein the step of inserting the CPA device into the female connector assembly at a full-lock position includes the step of a substantially elongated slot of at least a flexible member of the CPA device accommodating therein a substantially ramp-like member of the female connector assembly.

16. The method for assembling the male connector assembly and the female connector assembly as in claim 15, further comprising the step of transporting the male and female connector assemblies with the CPA device at the pre-lock position and with the male and female TPA devices at the pre-lock positions.

* * * * *